United States Patent [19]

Dupressoir et al.

[11] Patent Number: 4,529,989

[45] Date of Patent: Jul. 16, 1985

[54] MICROWAVE RADIATION SOURCE COMPRISING OPEN CAVITIES ENERGIZED BY TWO DIPOLES

[75] Inventors: Albert Dupressoir; Georges Devis, both of Paris, France

[73] Assignee: Thomson-CSF, Paris, France

[21] Appl. No.: 384,058

[22] Filed: Jun. 1, 1982

[30] Foreign Application Priority Data

Jun. 5, 1981 [FR] France ..... 81 11219

[51] Int. Cl.[3] ..... H01Q 21/28; H01Q 21/26

[52] U.S. Cl. ..... 343/756; 343/797; 343/786

[58] Field of Search ..... 343/797, 794, 793, 747, 343/727, 725, 780, 789, 893, 896, 898; 333/227, 21 A

[56] References Cited

U.S. PATENT DOCUMENTS

| | | | |
|---|---|---|---|
| 2,364,371 | 12/1944 | Katzin | 343/786 |
| 3,922,683 | 11/1975 | Kumpebeck | 343/797 |

FOREIGN PATENT DOCUMENTS

| | | | |
|---|---|---|---|
| 893476 | 7/1944 | France | 343/786 |
| 71961 | 3/1960 | France | 343/756 |
| 718828 | 11/1954 | United Kingdom | 343/756 |

*Primary Examiner*—Eli Lieberman
*Assistant Examiner*—K. Ohralik
*Attorney, Agent, or Firm*—Cushman, Darby & Cushman

[57] ABSTRACT

Microwave radiation source operating in two different frequency bands comprising two open cavities energized by two orthogonal dipoles, situated one within the other, the two cavities being wholly reflective for the waves transmitted by their corresponding energizing dipoles, and the interior cavity being transparent for the wave transmitted by the dipole energizing the exterior cavity.

13 Claims, 4 Drawing Figures

MICROWAVE RADIATION SOURCE COMPRISING OPEN CAVITIES ENERGIZED BY TWO DIPOLES

BACKGROUND OF THE INVENTION

The present invention relates to a radiation source comprising open cavities, energised by two dipoles which are orthogonal and preferably operating within the microwave range.

This source is usable as a primary energisation source for an optical system of the focussing type or as a radiating element of an antenna array, whether the array is in a linear plane or arranged on an other surface.

Amongst the different known embodiments of radiation sources having an open cavity energised by two orthogonal dipoles, none operates within two different frequency bands. As a matter of fact, they merely radiate two waves simultaneously according to two crossed polarisations or with a circular polarisation within a single frequency band. FIG. 1 illustrates a particular embodiment of such a prior art radiation source described in the review "Microwave Journal" of May 1977, pages 47 to 49, where the open cavity 1 is of the cylindrical type energised by two dipoles 2 and 3 arranged in cruciform fashion and comprising a plane element 4 placed in front of the radiating aperture 5 in order to enhance its directivity.

SUMMARY OF THE INVENTION

The object of the invention is to define a radiation source having open cavities, energised by two cruciformly arranged dipoles and operating in two different frequency bands.

To this end, this source has two concentric cavities, each being energised by one of the dipoles and tuned to the central frequency of the band of operating frequencies of its corresponding energising dipole, these two cavities, of which the corresponding apertures allowing radiation of the waves transmitted are positioned at the same side, moreover being situated the one within the other in such a manner that the cavity situated within the other operates within the higher frequency band.

According to a feature of the invention, the frequency difference between the two operating bands of the source exceeds the ratio 1:3.

BRIEF DESCRIPTION OF THE DRAWINGS

Other features of the invention will appear from the following description given with reference to FIGS. 2,3 and 4 which, as distinct from FIG. 1 described earlier and illustrating a prior art open cavity source, illustrate two embodiments of a dual band source having open cavities, FIGS. 2 and 4 being respectively exploded views of these two embodiments.

DESCRIPTION OF THE PREFERRED EMBODIMENTS

Figure 2:
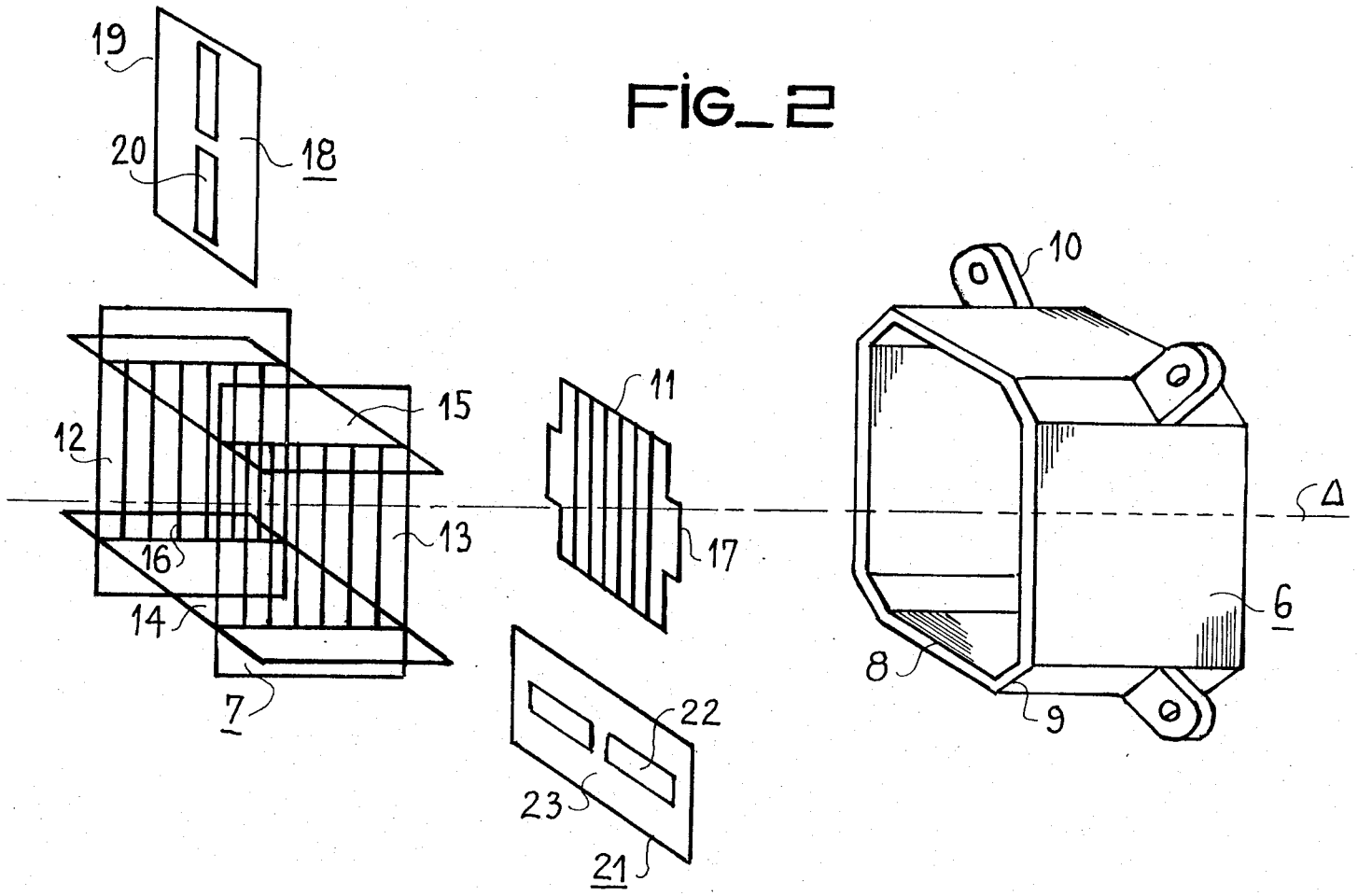

FIG. 2 shows an exploded view of a first embodiment of a radiation source, comprising two open cavities 6 and 7 energised by their corresponding dipoles 21 and 18, respectively, the exterior cavity 6 operating in the lower frequency band and the interior cavity 7 operating in the higher frequency band.

The exterior cavity 6 is totally reflective for the wave transmitted by its energising dipole 21 and comprises an aperture 8 at the transmitted radiation side, whereas the interior cavity 7 is reflective for the wave transmitted by its energising dipole 18 but semi-transparent for the wave radiated for the dipole 21. In this particular embodiment, the cross-sections of the cavities are square. The exterior cavity 6 is formed either by metal plates of small thickness, of light alloy for example, obtained by automatic brazing within a flux bath, or by small panels of metallised dielectric material. According to FIG. 2, the cross-section of this cavity 6 is square with the edges cut back to form the chamfer 9 for the purpose of fastening to the top of the main reflector of a Cassegrain system for example, of which the source thus produced would form the primary radiation assembly. The lugs 10 equally serve to effect this fastening. The cross-section of the cavity may have another form, as will be specified later.

The open interior cavity 7 comprises the base 11 and two lateral and mutually parallel sides 12 and 13 which are semi-transparent to the wave radiated by dipole 21, and two other sides 14 and 15 which are wholly reflective to the wave radiated by dipole 18. The aperture **7*a* of cavity 7 is equally situated at the transmitted radiation side and consequently at the same side as the aperture 8 of the cavity 6. Its cross-section has substantially the same form as that of the exterior cavity 6, with dimensions corresponding to its own band of operating frequencies but it lacks the cut-off or chamfered corners. This cavity 7 is produced by assembling five panels of dielectric material of small thickness, forming the base 11 and the four sides 12 to 15. The panels forming the walls 12 and 13 as well as the base 11 are partially metallised along parallel strips 16 solely on the inner surfaces of the sides and of the base of the cavity 7. The two other panels are wholly metallised on the inner surfaces of the sides 14 and 15. These five panels are metallised by the so-called photogravure process. Their assembling is effected according to the so-called "egg-box" technique, that is to say by means of notches and tongues 17 for the base or of slots 170** judiciously positioned within the panels to allow assembling.

The parallel metal strips deposited on the sides and base of the interior cavity 7 form a microwave grid of which the characteristics (module of the grid, width of the strips) may be adapted to make this grid equivalent to a short-circuiting plane for a wave polarised parallel to the direction of these strips and transparent for a wave of which the direction of polarisation is perpendicular to the strips of the grid. This interior cavity 7 is thus energisable by a dipole transmitting a wave of which the direction of polarisation is parallel to that of the metal strips 16 forming its two sides 12 and 13 and its base 11. This is why this cavity 7 can be energised by a dipole 18 which, in FIG. 2, is produced on a small dielectric plate 19, its sections 20 parallel to the strips 16 being applied thereon by photogravure. For the same reasons, the exterior cavity will be energised by a dipole 21 whose sections 22 are both orthogonal to the sections 20 of the dipole 18 and to the strips 16 of the base 11 and the sides 12 and 13 of the interior cavity 7. In FIG. 2, this dipole 21 is produced by photogravure on a small plate 23 of dielectric material, but it may be produced in a different manner, as may the dipole 18, by metal sections for example.

The radiating sections 20 and 22 of the corresponding dipoles 18 and 21 have a length equal to half the wavelength corresponding to the central frequency of their operating bands. The dipoles 18 and 21 are supplied via semi-rigid co-axial leads comprising a balancing system which permits the transposition from the unbalanced co-axial line to the balanced twin feeder line.

Thus, according to this embodiment of the invention, the interior cavity 7 has a volume clearly defined by its sides and the exterior cavity 6 has a volume equivalent to that defined by its outer surfaces. In order to produce a two-band radiation source presenting particular radiation characteristics, the energising dipoles are adjustable in position. Thus, these dipoles positioned in two planes at right angles to the longitudinal axis Δ of the radiating system and centered on this axis, have a position with respect to the short-circuiting planes, which constitutes the bases of the cavities to which they are allocated, which is adjustable as a function of these radio-electric characteristics required. When the microwave source is a primary source which does not radiate directly, that is to say illuminating a focussing optical system, the two radiation characteristics of the dipoles should be as close to each other as possible, with their phase centres thus being coincident.

Once this position has been determined, the panels 19 and 23 bearing the dipoles 18 and 21 are slid into slots formed in the sidewalls 12 to 15 of the inner cavity 7 and then secured by bonding, the electrical connections between the different metallised portions being provided, for example, by low temperature tin-soldered joints. Finally, the interior cavity 6 is secured to the cavity 7 by bonding the four dielectric panels on the inner sides of the cavity 6 by means of an epoxy resin, for example.

Figure 1:
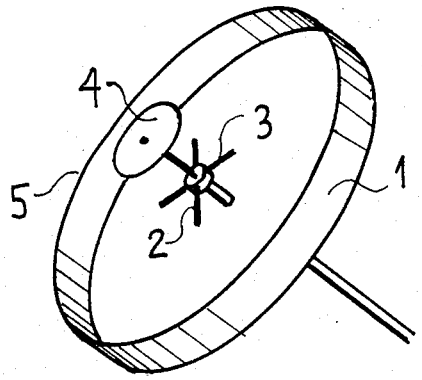
FIG 1 PRIOR ART
Figure 3:
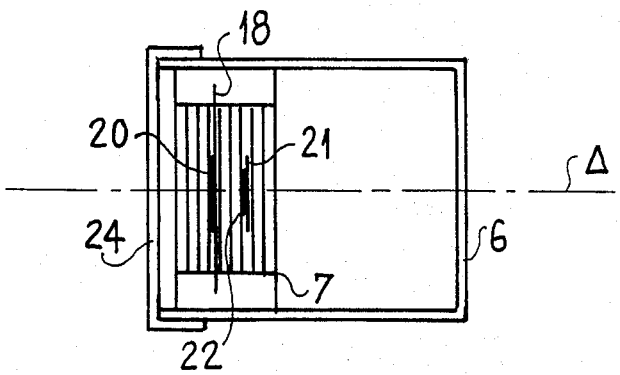

Finally, to assure sealing of this dual band source having open cavities, a radome 24 is placed over the opening of the source as shown in FIG. 3, illustrating a side view of an embodiment of a dual band source according to the invention. It may be formed from a thin gauge material consisting of a glass fibre fabric impregnated with epoxy resin.

In one particular embodiment where the frequency separation between the two operating bands exceeds the ration 1:3, the dimensions of the exterior cavity 6 are the following 1.3λo and 1.5λo for the sides of its cross-section and 0.55λo for the depth, λo being the wavelength at the central frequency of the operating band. The width separating two metal strips 16 of the side surfaces or of the base of the interior cavity 7 is equal to λo/20 and the thickness of the radome 24 is approximately 0.3 mm.

Figure 4:
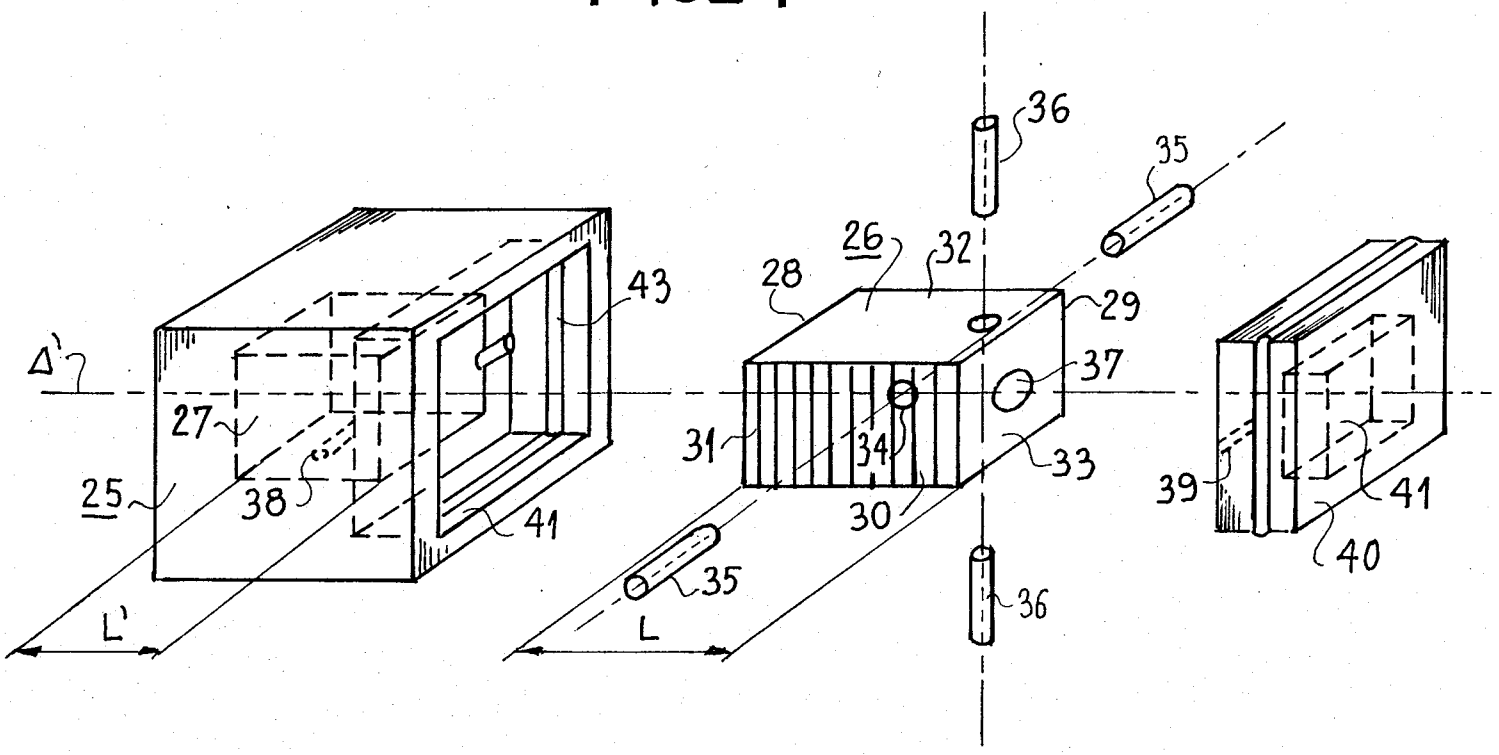

FIG. 4 shows a second embodiment of a dual band radiation source having concentric open cavities in accordance with the invention. The exterior and interior cavities 25 and 26 are respectively formed by blocks of dielectric material wholly or partially metallised along their sides and produced by moulding.

The exterior cavity 25 is formed by a dielectric block wholly metallised on five external sides, according to a conventional photogravure process for example, and comprising a recessed portion 27 whose volume is substantially equal to that of the interior cavity 26.

This cavity 26 is formed by a dielectric block of which the base 28 and two mutually parallel lateral sides 29 and 30 perpendicular to the base 18 carry grids of parallel metal strips 31, the other two sides 32 and 33 which are mutually parallel and perpendicular to the base 28 being wholly metallised, for example by photogravure. This block has two channels 34 symmetrical to the longitudinal axis Δ' of the cavities. In these two channels are secured two metal section 35 acting as a dipole energising the exterior cavity 25. The dipole energising the interior cavity 26 is formed by two metal sections 36 perpendicular to the preceding sections 35 and wholly contained within this cavity. For practical constructional reasons, an orifice 37 is provided in the front surface of the block forming the cavity 26 along the axis Δ' so that the dipole sections may be brazed to the co-axial supply wires; this orifice 37 may moreover be sealed by a plug of dielectric material.

The sections 36 of the dipole energising the interior cavity 26 are held within the same by bonding, whereas the sections 35 of the dipole energising the exterior cavity 25 are partially secured in the dielectric block of the cavity 26 by bonding for example, and partially due on the one hand to grooves 38 provided in the dielectric block forming the cavity 25 and on the other hand to other grooves 39 which are situated in a dielectric cover 40 seating in the aperture of the exterior cavity 25. The latter has a recess for seating this cover, comprised between the aperture of the recessed portion 27 and the aperture of the exterior cavity itself. The length L of the interior cavity 26—or dimension along the axis Δ'—is greater than the length L' of the recessed part 27 of the external cavity 25. The lid 40 also comprises a recess 41 formed in the extension of the part 27. The cavity 26 is thus situated within the cavity 25 inset in the recessed part 27 and in the recess 41 of the lid 40.

A description has thus been given of a microwave radiation source comprising two open cavities energised by two orthogonal dipoles and operating in two different frequency bands. This source may be utilised within an antenna array.

What is claimed is:

1. A microwave radiating source comprising:

a first dipole emitting a first wave in a first frequency operating band having a first central frequency;

means defining a first cavity establishing a first radiating aperture and being energized by said first dipole, said first cavity being wholly reflective for said first wave emitted by said first dipole and being tuned to said first central frequency of the operating band of said first dipole;

a second dipole, orthogonal to said first dipole, emitting a second wave in a second frequency operating band higher than said first frequency operating band, said second frequency band having a second central frequency means defining a second cavity establishing a second radiating aperture and being energised by said second dipole, said second cavity being wholly reflective for said second wave emitted by said second dipole and being tuned to said second central frequency of the operating band of said second dipole, said second cavity being situated within said first cavity, said second radiating aperture being situated in the same plane as and having a lesser dimension than said first radiating aperture, and said second cavity being transparent for the wave emitted by said first dipole which operates within the lower band of operating frequencies.

2. A source as claimed in claim 1, wherein the frequency difference between the frequency operating bands of said first and second dipoles exceeds the ratio 1:3.

3. A microwave radiating source comprising:

a first dipole emitting a first wave in a first frequency operating band having a first central frequency;

means defining a first cavity establishing a first radiating aperture and being energised by said first dipole, said first cavity being wholly reflective for said first wave emitted by said first dipole and being tuned to said first central frequency of the operating band of said first dipole;

a second dipole, orthogonal to said first dipole, emitting a second wave in a second frequency operating band higher than said first frequency operating band, said second frequency band having a second central frequency;

means defining a second cavity establishing a second radiating aperture and being energised by said second dipole, said second cavity being wholly reflective for said second wave emitted by said second dipole and being tuned to said second central frequency of the operating band of said second dipole, said second cavity being situated within said first cavity, said second radiating aperture being situated in the same plane as said first radiating aperture, and said second cavity being transparent for the wave emitted by said first dipole which operates within the lower band of operating frequencies, and wherein said second cavity comprises a base and four sides perpendicular to said base, said base and a first pair of said sides being semi-transparent to said first wave emitted by said first dipole, each being formed by a grid of strips parallel to sections of said second dipole energising said second cavity.

4. A source as claimed in claim 1, further comprising a radome placed over said first radiating aperture of said first radiating cavity.

5. A source as claimed in claim 3 wherein each of said first and second cavities has a cross-section of square shape and the same longitudinal axis.

6. A source as claimed in claim 3, wherein said first and second cavities are formed by panels of dielectric material, said first cavity being formed from five wholly metallised panels and said second cavity being formed by three partially metallised panels corresponding to said base and to said first pair of said four sides, and by two wholly metallised panels corresponding to a second pair of said four sides.

7. A source as claimed in claim 6, wherein the panels corresponding to said base and to said first pair of said four sides of said second cavity are metallised along parallel strips deposited by a photogravure process.

8. A source as claimed in claim 6, wherein the panels of dielectric material forming said second cavity comprise notches, tongues and slots permitting their assembly.

9. A source as claimed in claim 1, wherein said two dipoles are applied by photogravure on small plates of dielectric material, their corresponding sections being orthogonal.

10. A microwave radiating source comprising:

a first dipole emitting a first wave in a first frequency operating band having a first central frequency;

means defining a first cavity establishing a first radiating aperture and being energised by said first dipole, said first cavity being wholly reflective for said first wave emitted by said first dipole and being tuned to said first central frequency of the operating band of said first dipole;

a second dipole, orthogonal to said first dipole, emitting a second wave in a second frequency operating band higher than said first frequency operating band, said second frequency band having a first central frequency;

means defining a second cavity establishing a second radiating aperture and being energised by said second dipole, said second cavity being wholly reflective for said second wave emitted by said second dipole and being tuned to said second central frequency of the operating band of said second dipole, said second cavity being situated within said first cavity, said second radiating aperture being situated in the same plane as said first radiating aperture, and said second cavity being transparent for the wave emitted by said first dipole which operates within the lower band of operating frequencies, wherein said first cavity is formed by a block of wholly metallised dielectric material comprising a recessed portion in which is situated the second cavity, said second cavity being formed by a partially metallised dielectric block, said second dipole energising said second cavity being formed by two metallic sections wholly contained therein, and said first dipole energising said first cavity being formed by two metal sections secured in two channels formed in said dielectric block of said cavity and symmetrical with respect to the longitudinal axis of said source.

11. A source as claimed in claim 10, wherein an orifice is formed in a front surface of said first cavity and is closed by a dielectric plug.

12. A source as claimed in claim 10, wherein an orifice is formed in a front surface of said second cavity and is closed by a dielectric plug.

13. A source as claimed in claim 3 wherein each of said first and second cavities has a cross-section of rectangular shape and the same longitudinal axis.

* * * * *